US010011974B2

(12) United States Patent
Zhang et al.

(10) Patent No.: US 10,011,974 B2
(45) **Date of Patent: *Jul. 3, 2018**

(54) IMPLEMENT CONTROL BASED ON NOISE VALUES

(71) Applicant: Caterpillar Trimble Control Technologies LLC, Dayton, OH (US)

(72) Inventors: Yanchai Zhang, Dunlap, IL (US); Francisco R. Green, New Carlisle, OH (US); Albert A. Wray, Sidney, OH (US); Insu Chang, Peoria, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/426,624

(22) Filed: Feb. 7, 2017

(65) Prior Publication Data

US 2017/0175360 A1 Jun. 22, 2017

Related U.S. Application Data

(63) Continuation of application No. 14/978,628, filed on Dec. 22, 2015, now Pat. No. 9,598,844.

(51) Int. Cl.
*E02F 1/00* (2006.01)
*E02F 9/20* (2006.01)
(Continued)

(52) U.S. Cl.
CPC ..... *E02F 9/2041* (2013.01); *E02F 1/00* (2013.01); *G07C 5/02* (2013.01); *E02F 3/32* (2013.01);
(Continued)

(58) Field of Classification Search
USPC ..... 701/50; 172/2, 4.5; 700/254, 275, 301; 702/94
See application file for complete search history.

(56) References Cited

U.S. PATENT DOCUMENTS 4,920,305 A * 4/1990 Benson ..... F15B 19/002 318/657
5,615,114 A 3/1997 Nordin
(Continued)

FOREIGN PATENT DOCUMENTS

RU 2565597 10/2015
SU 1813144 4/1993
WO 2013089299 A1 6/2013

OTHER PUBLICATIONS

Wikipedia, "International Roughness Index", http://en.wikipedia.org/wiki/International_Roughness_Index, Jun. 20, 2016.
(Continued)

*Primary Examiner* — Richard A Goldman
(74) *Attorney, Agent, or Firm* — Dinsmore & Shohl, LLP

(57) ABSTRACT

An earthmoving machine comprises a sensor, an implement, and control architecture comprising a controller and configured to facilitate movement in response to a signal indicative of a measured implement position and an implement control value comprising a gain value associated with implement speed. The controller is programmed to execute machine readable instructions to generate a noise value that is based on an error between the signal and a target signal, determine whether the noise value is acceptable to lock the gain value, adjust the gain value to control the implement speed when the noise value is unacceptable until the noise value is acceptable, and operate the machine based on the locked gain value.

20 Claims, 5 Drawing Sheets

(51) Int. Cl.

| | |
|---|---|
| ***G07C 5/02*** | (2006.01) |
| *E02F 3/84* | (2006.01) |
| *E02F 3/43* | (2006.01) |
| *E02F 3/76* | (2006.01) |
| *E02F 3/32* | (2006.01) |

(52) U.S. Cl.
CPC ..... *E02F 3/435* (2013.01); *E02F 3/7609* (2013.01); *E02F 3/844* (2013.01)

(56) References Cited

U.S. PATENT DOCUMENTS 5,918,195 A * 6/1999 Halgrimson ..... A01B 63/00 318/624
6,615,114 B1 * 9/2003 Skiba ..... E02F 9/2025 172/2
8,061,180 B2 * 11/2011 Green ..... F15B 19/002 73/1.72
8,082,084 B2 * 12/2011 Nichols ..... E02F 3/3414 37/438
8,371,769 B2 * 2/2013 Worsley ..... E01C 23/07 404/118
8,596,373 B2 * 12/2013 Montgomery ..... E02F 3/847 172/2
8,634,991 B2 * 1/2014 Douglas ..... E02F 3/845 172/4.5
8,689,471 B2 * 4/2014 Carpenter ..... F15B 3/00 37/348
2010/0299031 A1 11/2010 Zhdanov et al.
2012/0000681 A1 1/2012 Douglas
2013/0068309 A1 * 3/2013 Anderson ..... F15B 19/002 137/1
2014/0165692 A1 * 6/2014 Rannow ..... F15B 19/002 73/1.63
2016/0040388 A1 * 2/2016 Kontz ..... E02F 3/84 701/50
2016/0146618 A1 * 5/2016 Caveney ..... G05D 1/06 701/25

OTHER PUBLICATIONS

Bituminous Smoothness Training Workshop, "Introduction to the International Roughness Index", http://www.dot.state.mn.us/materials/smoothnessdods/IRIIntroduction.pdf, Apr. 11, 2007.
Sayers et al., "The Little Book of Profiling Basic Information about Measuring and Interpreting Road Profiles", The Regent of the University of Michigan, http://www.umich.edu/content/LittleBook98R.pdf, Sep. 1988.
International Search Report and Written Opinion filed in International Application No. PCT/US2016/067109 dated Jun. 8, 2017.

* cited by examiner

IMPLEMENT CONTROL BASED ON NOISE VALUES

CROSS-REFERENCE TO RELATED APPLICATION

This application is a continuation application of U.S. patent application Ser. No. 14/978,628 filed Dec. 22, 2015, the entire disclosure of which is hereby incorporated herein by reference.

BACKGROUND

The present disclosure relates to earthmoving machines and, more particularly, to earthmoving machines where the earthmoving implement is subject to adaptive control. For example, and not by way of limitation, many types of terrain-based earthmoving machines, such as bulldozers, pavers, excavator, loaders, scrapers, etc., typically have a hydraulically controlled earthmoving implement that can be manipulated by a joystick or other means in an operator control station of the machine, and is also subject to partially or fully automated adaptive control. For example, the user of the machine may control the lift, tilt, angle, and pitch of the implement. In addition, one or more of these variables may also be subject to partially or fully automated control based on information sensed or received by an adaptive environmental sensor of the machine. For example, and not by way of limitation, it is contemplated that aspects of the present disclosure may be applicable to technology similar to that represented by the disclosures of U.S. Pat. No. 8,689,471, which is assigned to Caterpillar Trimble Control Technologies LLC and discloses methodology for sensor-based automatic control of an excavator, U.S. Pat. No. 8,634,991, which is assigned to Caterpillar Trimble Control Technologies LLC and discloses an automated earthmoving system of the type that incorporates a bulldozer for contouring a tract of land to a desired finish shape, U.S. Pat. No. 8,371,769, which is assigned to Caterpillar Trimble Control Technologies LLC and relates to automated control of a paving machine, and U.S. Pat. No. 8,082,084, which is assigned to Caterpillar Trimble Control Technologies LLC and relates to sensor-based automated control of a loader.

BRIEF SUMMARY

In accordance with one embodiment of the present disclosure, an earthmoving machine is provided comprising a machine chassis, a linkage mechanism, an earthmoving implement, an adaptive environmental sensor, and control architecture. The earthmoving implement is coupled to the machine chassis via the linkage mechanism. The control architecture is configured to facilitate movement of the earthmoving implement, the machine chassis, and the linkage mechanism in one or more degrees of freedom at least partially in response to an implement control value and an adaptive signal. The implement control value represents control of the movement of the earthmoving implement and comprises a gain value as a parameter thereof. The implement control gain value is associated with a speed of movement of the earthmoving implement. The adaptive signal is generated by the adaptive environmental sensor and is indicative of a measured position of the earthmoving implement relative to a given operational terrain. The control architecture comprises a machine controller that is programmed to execute machine readable instructions to generate a surface-based cost function value that is based on the adaptive signal or a comparison of the adaptive signal to a target position signal indicative of a target position of the earthmoving implement, determine whether the surface-based cost function value is at an acceptable level or an unacceptable level, lock the implement control gain value when the surface-based cost function value is at the acceptable level, and generate a noise value that is based on an error between the adaptive signal and the target position signal when the surface-based cost function value is at the unacceptable level. The machine controller is further programmed to execute machine readable instructions to determine whether the noise value is at an acceptable noise level or an unacceptable noise level, lock the implement control gain value when the noise value is at the acceptable noise level, adjust the implement control gain value to control the implement speed when the noise value is at the unacceptable noise level until the surface-based cost function value is at the acceptable level or the noise value is at the acceptable noise level, and the implement control gain value is locked, and operate the earthmoving machine based on the locked implement control gain value.

In accordance with another embodiment of the present disclosure, an earthmoving machine is provided comprising a machine chassis, a linkage mechanism, an earthmoving implement, an adaptive environmental sensor, and control architecture. The earthmoving implement is coupled to the machine chassis via the linkage mechanism. The control architecture is configured to facilitate movement of the earthmoving implement, the machine chassis, and the linkage mechanism in one or more degrees of freedom at least partially in response to an implement control value and an adaptive signal. The implement control value represents control of the movement of the earthmoving implement and comprises a gain value as a parameter thereof. The implement control gain value is associated with a speed of movement of the earthmoving implement. The adaptive signal is generated by the adaptive environmental sensor and is indicative of a measured position of the earthmoving implement relative to a given operational terrain. And the control architecture comprises a machine controller that is programmed to execute machine readable instructions to generate a surface-based cost function value that is based on the adaptive signal or a comparison of the adaptive signal to a target position signal indicative of a target position of the earthmoving implement, determine whether the surface-based cost function value is at an acceptable level or an unacceptable level, lock the implement control gain value when the surface-based cost function value is at the acceptable level, generate a noise value when the surface-based cost function value is at the unacceptable level, wherein the noise value that is based on an error between the adaptive signal and the target position signal and is generated, at least in part, by dividing a machine travel speed value by a terrain bump count frequency value. The machine controller is further programmed to execute machine readable instructions to determine whether the noise value is at an acceptable noise level or an unacceptable noise level by applying a Fast Fourier Transform (FFT) operation to the noise value to convert the noise value from a time domain into a frequency domain to generate a frequency-based noise value and comparing the frequency-based noise value to a frequency-based noise threshold, lock the implement control gain value when the noise value is at the acceptable noise level, adjust the implement control gain value to decrease the implement speed when the noise value is greater than a noise threshold and increase the implement speed when the noise value is less than a noise threshold until the surface-based cost function value is at the acceptable level or the noise value is at the acceptable noise level, and the implement control gain value is locked, and operate the earthmoving machine based on the locked implement control gain value.

In accordance with another embodiment of the present disclosure, a method of operating an earthmoving machine is provided comprising disposing an earthmoving machine on a given operational terrain, the earthmoving machine comprising a machine chassis, a linkage mechanism, an earthmoving implement, an adaptive environmental sensor, and control architecture comprising a machine controller, wherein the earthmoving implement is coupled to the machine chassis via the linkage mechanism. The method further comprises utilizing the control architecture to facilitate movement of the earthmoving implement, the machine chassis, and the linkage mechanism in one or more degrees of freedom at least partially in response to an implement control value and an adaptive signal, wherein the implement control value represents control of the movement of the earthmoving implement and comprises a gain value as a parameter thereof, the implement control gain value is associated with a speed of movement of the earthmoving implement, and the adaptive signal is generated by the adaptive environmental sensor and is indicative of a measured position of the earthmoving implement relative to the given operational terrain. The method further comprises generating, by the machine controller, a surface-based cost function value that is based on the adaptive signal or a comparison of the adaptive signal to a target position signal indicative of a target position of the earthmoving implement, determining whether the surface-based cost function value is at an acceptable level or an unacceptable level, locking the implement control gain value when the surface-based cost function value is at the acceptable level, generating, by the machine controller, a noise value that is based on an error between the adaptive signal and the target position signal when the surface-based cost function value is at the unacceptable level, determining whether the noise value is at an acceptable noise level or an unacceptable noise level, locking the implement control gain value when the noise value is at the acceptable noise level, adjusting, by the machine controller, the implement control gain value to control the implement speed of the earthmoving implement when the noise value is at the unacceptable noise level until the surface-based cost function value is at the acceptable level or the noise value is at the acceptable noise level, and the implement control gain value is locked, and operating the earthmoving machine based on the locked implement control gain value.

Although the concepts of the present disclosure are described herein with primary reference to bulldozers, pavers, excavator, and loaders it is contemplated that the concepts will enjoy applicability to any a terrain-based machine that is configured to move matter disposed on, supported by, or forming part of the surface of the earth. For example, and not by way of limitation, contemplated earthmoving machines include a dozer (i.e., a bulldozer), where the earthmoving implement comprises a dozer blade, a grader (i.e., a motor grader), where the earthmoving implement comprises a grader blade, a paver (such as an asphalt paver or a concrete paver), where the earthmoving implement comprises a paver blade (such as, respectively, a screed to set asphalt height or a pan to set concrete height), an excavator, where the earthmoving implement comprises a bucket comprising a cutting edge blade, a cold planer/mill, where the earthmoving implement comprises a drum to grind material away, or a scraper, where the earthmoving implement comprises a hopper comprising a cutting edge blade.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
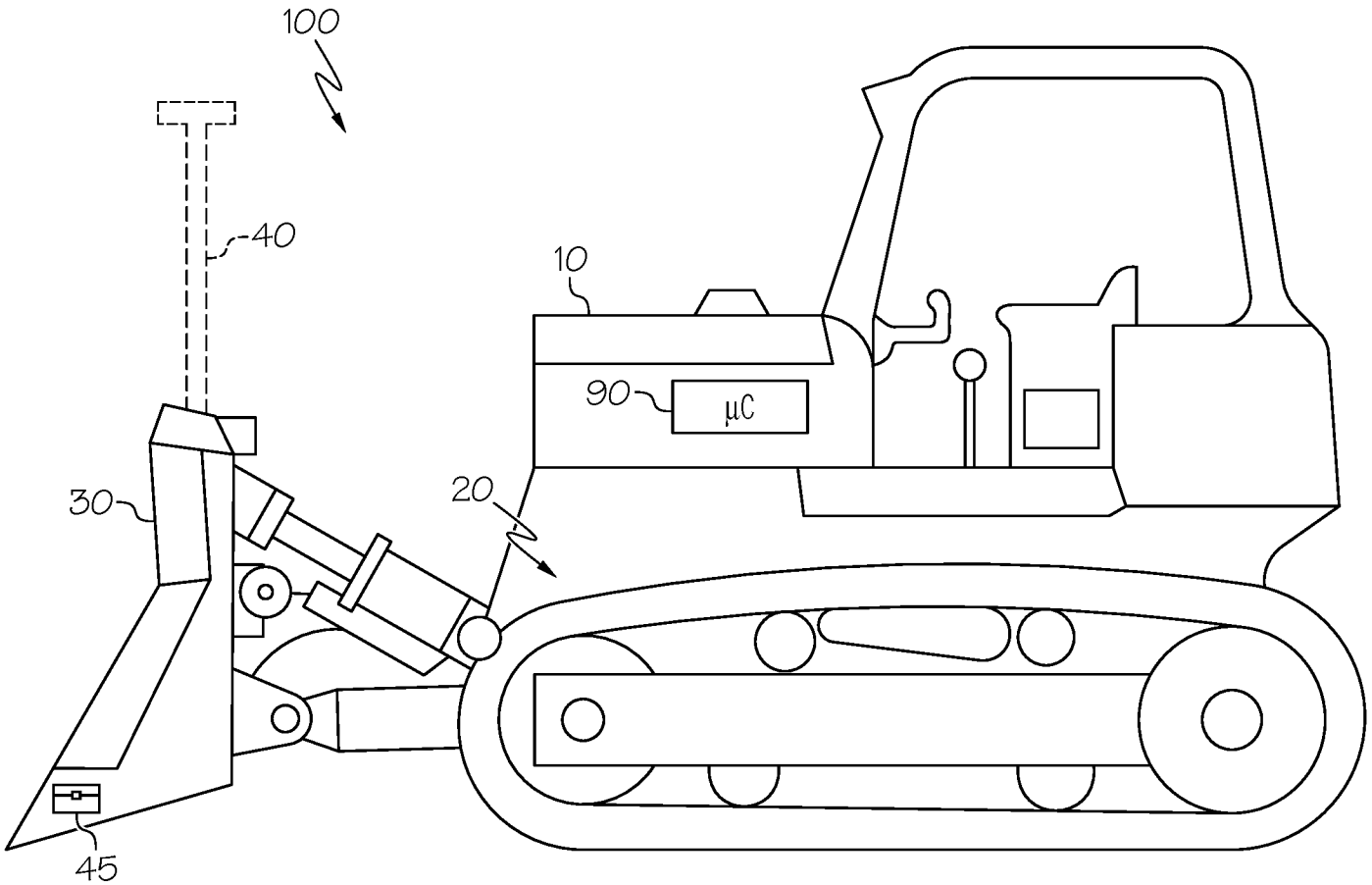
FIG. 1 illustrates an earthmoving machine incorporating aspects of the present disclosure in the form of a dozer.

Referring initially to FIG. 1, which illustrates an earthmoving machine 100 in the form of a dozer, it is noted that earthmoving machines according to the present disclosure will typically comprise a machine chassis 10, a linkage mechanism 20, an earthmoving implement 30, e.g., a dozer blade, one or more adaptive environmental sensors 40, 45, e.g., and suitable control architecture. Similarly, referring to FIG. 2, which illustrates an earthmoving machine 100' in the form of an excavator, the excavator will typically comprise a machine chassis 10', a linkage mechanism 20', an earthmoving implement 30', e.g., a bucket comprising a cutting edge blade, one or more adaptive environmental sensors 40', 45', and suitable control architecture.

As will be appreciated by those practicing the concepts of the present disclosure, contemplated earthmoving machines may employ one or more of a variety of conventional or yet-to-be developed adaptive environmental sensors. For example, and not by way of limitation, currently contemplated sensors include global positioning system (GPS) sensors, global navigation satellite system (GNSS) receivers, laser scanners, laser receivers, inertial measurement units (IMUs), inclinometers, accelerometers, gyroscopes, or combinations thereof. Further, while the adaptive environmental sensors 40, 45, 40', 45' are illustrated as located on the earthmoving implement 30, 30' (or a stick component associated with the earthmoving implement 30 in FIG. 1), it is contemplated that such adaptive environmental sensors 40, 45, 40', 45' may be positioned on other locations of the earthmoving machine 100, 100' such as the linkage mechanism 20, 20' and/or a platform of the earthmoving machine 100, 100'. Such adaptive environmental sensors 40, 45, 40', 45' may be utilized to calculate a height of an edge of the earthmoving implement 30, 30', such as a cutting edge or teeth of the edge.

Figure 2:
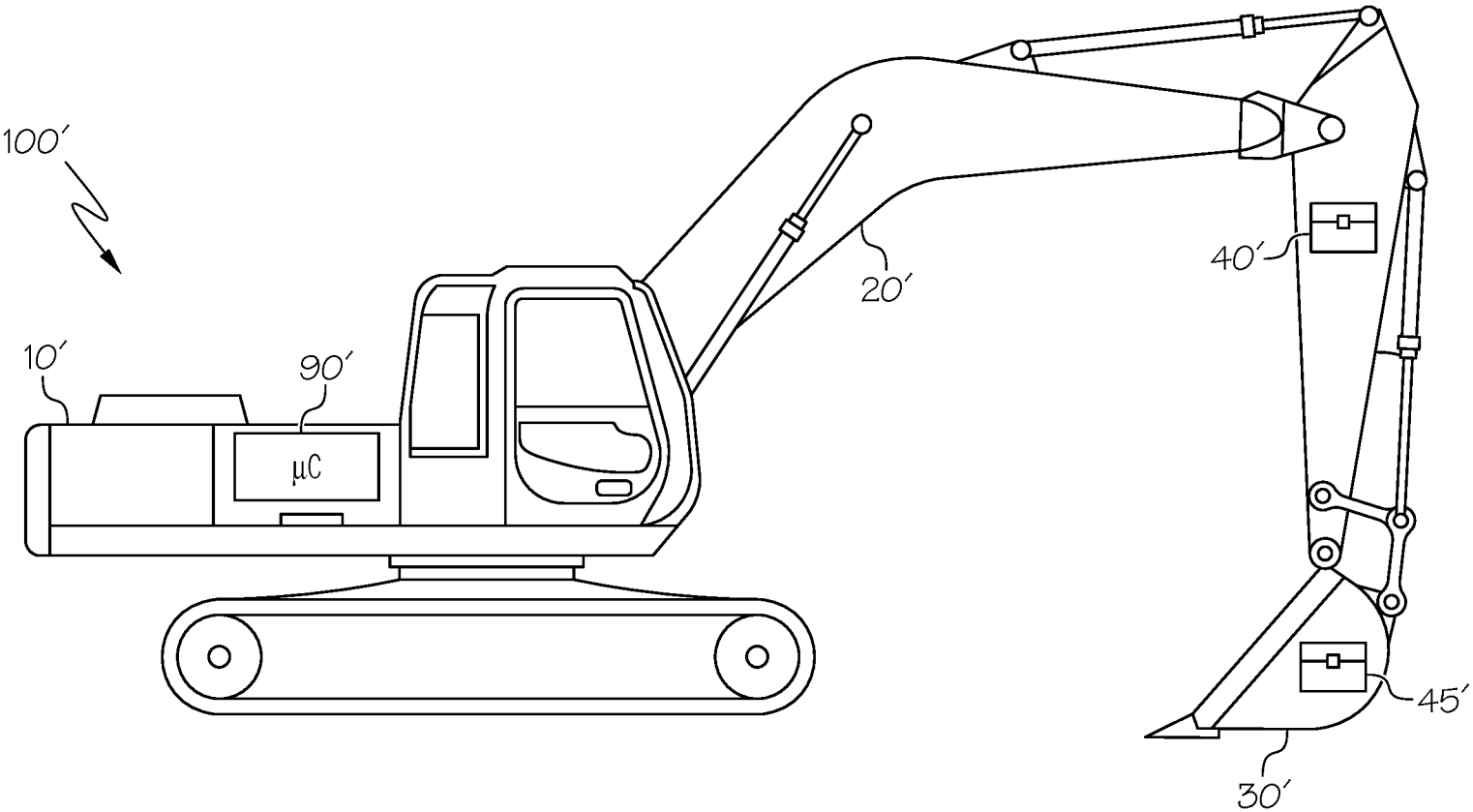
FIG. 2 illustrates an earthmoving machine incorporating aspects of the present disclosure in the form of an excavator.

As is illustrated in FIGS. 1 and 2, the earthmoving implement 30, 30' may be coupled to the machine chassis 10, 10' via the linkage mechanism 20, 20'. The control architecture may comprise, for example, a machine controller 90, 90' and one or more actuators to facilitate movement of the earthmoving implement 30, 30', the machine chassis 10, 10', and the linkage mechanism 20, 20'. For ease of reference, the numbering of the embodiment of FIG. 1 will be referenced hereinafter with respect to machine chassis 10, linkage mechanism 20, earthmoving implement 30, sensors 40, 45, machine controller 90, and earthmoving machine 100, but mention of such components when referenced herein should be understood to include the components of the embodiment of FIG. 2 and other terrain-based machine embodiments. Contemplated actuators include any conventional or yet-to-be developed earthmoving machine actuators including, for example, hydraulic cylinder actuators, pneumatic cylinder actuators, electrical actuators, mechanical actuators, or combinations thereof.

In any case, the control architecture is configured to facilitate movement of the earthmoving implement 30, the machine chassis 10, and the linkage mechanism 20 in one or more degrees of freedom. This movement will typically be at least partially in response to an adaptive signal and an implement control value. The adaptive signal, examples of which are described in the above-noted patent literature related to automated adaptive control in earthmoving machines, is generated by the adaptive environmental sensor and is indicative of a measured position of the earthmoving implement 30 relative to a given operational terrain. The implement control value represents control of the movement of the earthmoving implement 30 and comprises a gain value as a parameter thereof. This gain value can be associated with a speed of movement of the earthmoving implement 30. For the purposes of defining and describing the present invention, it should be understood that the speed of movement of the earth moving implement refers to the speed at which the earth moving implement 30 is automatically moved or adjusted with respect to a given operational terrain and as based on the implement control gain value.

Typically, the machine controller 90 is configured to generate a command current that is based on the implement control value. For example, and not by way of limitation, the command current may be configured to cause actuator(s) associated with the earthmoving implement 30 and/or the linkage mechanism 20 to move and cause the earthmoving implement 30 and/or the linkage mechanism 20 to move. This current may, for example, represent a signal associated with a valve of the actuator and may, for example, be an analog, digital, or pulse-width-modulated signal.

Figure 3:
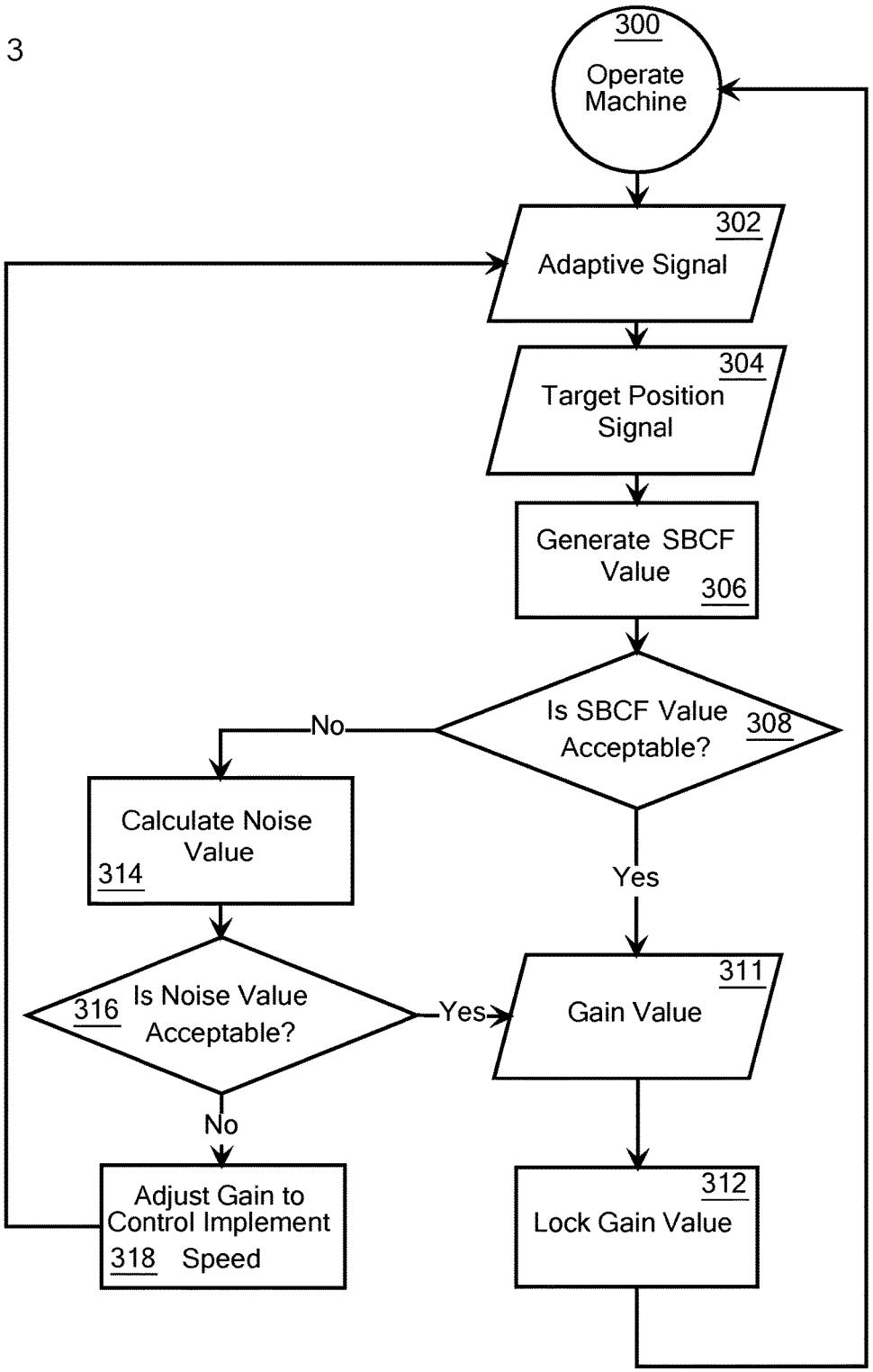
FIGS. 3-5 are flow charts illustrating instructions implemented by control architecture according to various concepts of the present disclosure.

As is illustrated in the operational flow chart of FIG. 3, a user such as an operator may initiate or continue machine operation in step 300. In step 302, the adaptive signal is input. In step 304, a target position signal indicative of a target position of the earthmoving implement 30 is input. In one embodiment of the present disclosure, the control architecture comprises a machine controller 90 that is programmed, given the adaptive signal and the target position signal, to execute machine readable instructions to generate a surface-based cost function (SBCF) value in step 306. The SBCF value is based on the adaptive signal or a comparison of the adaptive signal to the target position signal.

In the control scheme of FIG. 3, the machine controller 90 next determines in step 308 whether the SBCF value is at an acceptable level or an unacceptable level and locks the implement control gain value (see steps 311 and 312) when the SBCF value is at the acceptable level. Otherwise, the machine controller 90 generates, by calculation or otherwise, a noise value in step 314 that is based on an error between the adaptive signal and the target position signal when the SBCF value is at the unacceptable level.

In step 316, the machine controller 90 determines whether the noise value is at an acceptable noise level or an unacceptable noise level. If the aforementioned noise value is at an acceptable noise level, the implement control gain value is locked (see steps 311 and 312). If the noise value is at the unacceptable noise level, the machine controller 90 adjusts the implement control gain value to control the implement speed (step 318) until the SBCF value is at the acceptable level (following the order of steps 302-311) or the noise value is at the acceptable noise level (following the order of steps 302-308, 314-316, and 311). At this point, the implement control gain value can be locked (step 312) and the earthmoving machine can be operated based on the locked implement control gain value (step 300). In this manner, the operational flow of FIG. 3, and equivalents thereof, provide for dynamic auto-tuning of the machine controller 90; more specifically, for dynamic calibration of the implement control gain value.

The SBCF value can be based on an estimation of a position of the earthmoving implement 30 with respect to space over the given operational terrain, e.g., as derived from a GPS sensor or another type of positional sensor. Where implement pitch is subject to machine control, it is further contemplated that the estimation of the position of the earthmoving implement 30 can be based on an angular pitch reading of the implement, as generated by an IMU, for example, and a predetermined height of the implement 30 relative to the given operational terrain.

Regarding step 308, it is contemplated that the SBCF value can be compared to a cost function threshold to aid in the determination of whether the SBCF value is at an acceptable level or an unacceptable level. This threshold may be a discrete value or a range of values tailored to account for permissible variances in the threshold and/or permissible degrees to which the SBCF value may depart from the threshold without initiating corrective action.

Figure 4:
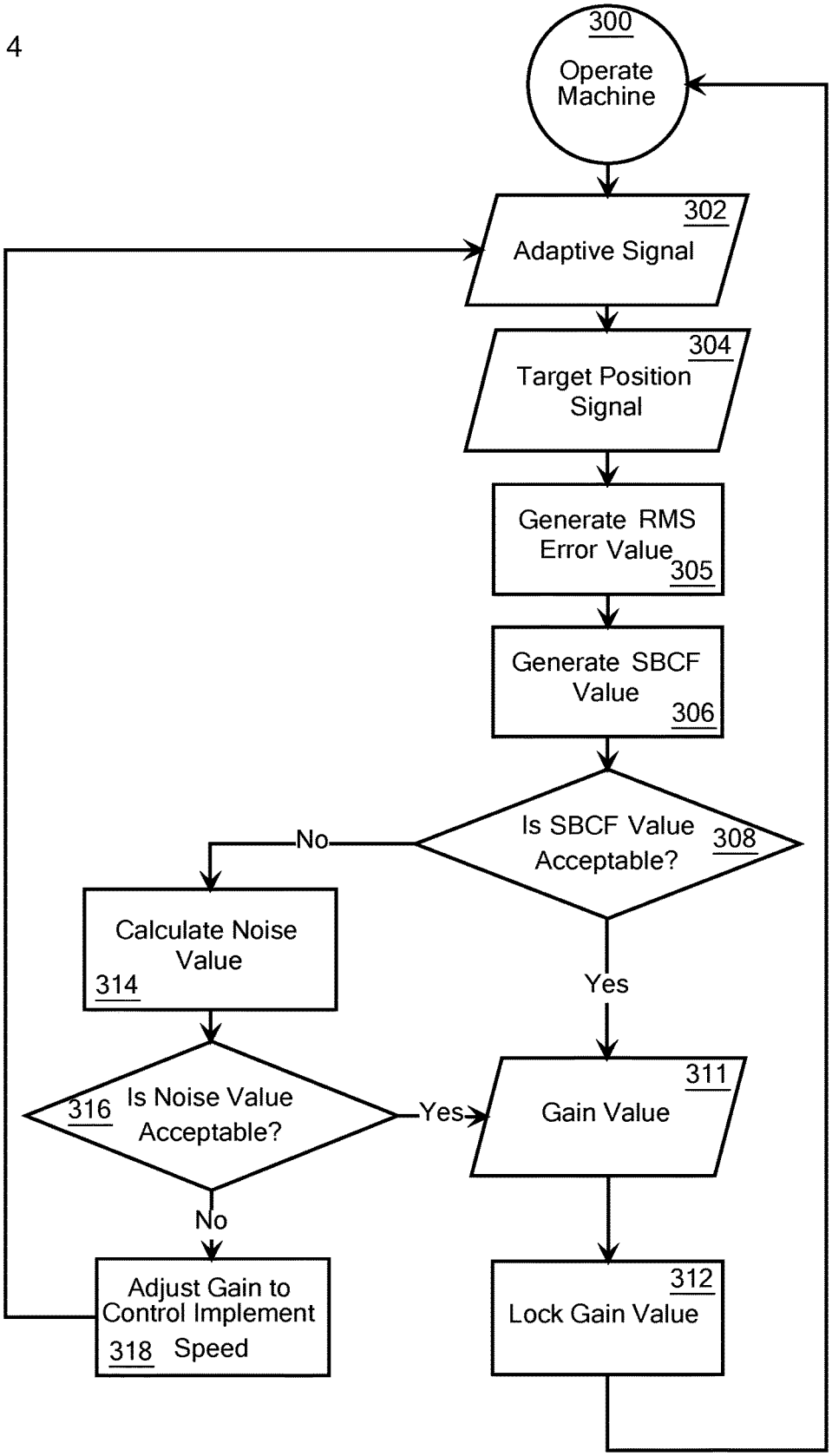

Referring to the operational flow chart of FIG. 4, where like elements are carried over from the flow chart of FIG. 3, it is contemplated that the SBCF value can be based on a root mean square (RMS) error value (see step 305) that is associated with the measured position of the earthmoving implement and a comparison of the adaptive signal to the target position signal. More specifically, the SBCF value may be a waviness number that is indicative of the terrain surface profile. This waviness number may, for example, be based on an International Roughness Index (IRI) value and the RMS error value. The RMS error value may, in turn, result from a comparison of the adaptive signal to the target signal.

In another contemplated embodiment, the waviness number may be based on an IRI value and a maximum variation of an error range between the adaptive signal and the target signal. More specifically, the maximum variation in the error range may be based on a difference between a maximum error range and a minimum error range of a plurality of error ranges over predetermined travel distance window. These error ranges may represent a difference between a pair of data points setting forth respective expected and actual position measurements of the earthmoving implement 30 related to the given operational terrain and are also measured over the travel distance window.

Regarding reference herein to the IRI value, it is noted that this value is well documented in profiling literature including, for example, Sayers et al., "The Little Book of Profiling," published by the Regent of the University of Michigan, September, 1998. It is contemplated herein that a computer-based virtual response type system may be utilized to generate the IRI value to provide an index value having units of slope as roughness indices of a terrain surface profile of the given operational terrain over a distance window. For example, and not by way of limitation, the IRI value may be based on a simulated suspension motion of the earthmoving machine 100 accumulated and divided by a distance traveled by the earthmoving machine 100. This travel distance may be measured over a distance window that is indicative of a predetermined distance traveled by the earthmoving machine 100 over the given operational terrain. Units of slope may, for example, be measured as m/km or in/mi.

Figure 5:
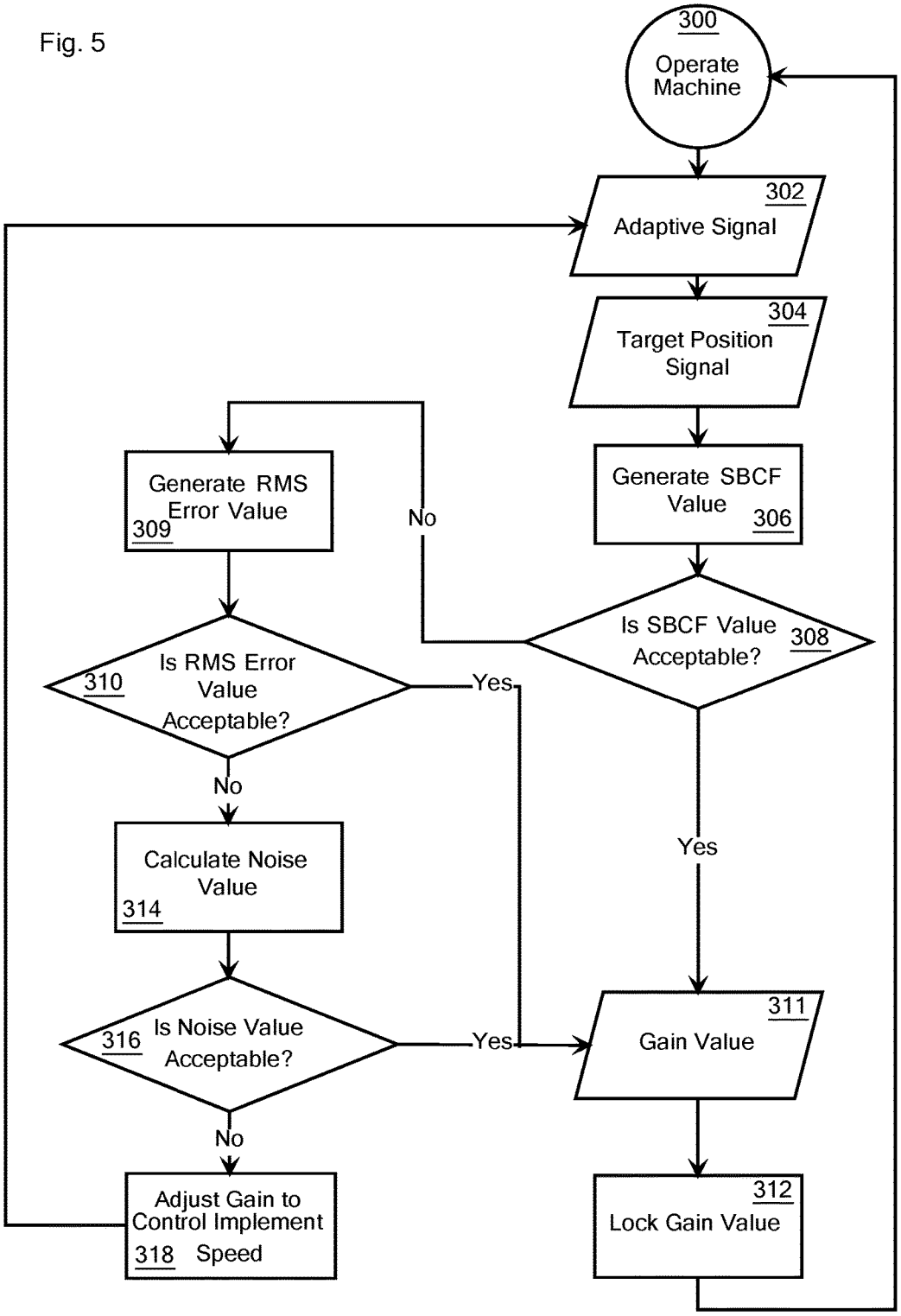

According to the alternative operational flow chart of FIG. 5, where like elements are carried over from the flow chart of FIG. 3, the machine controller 90 is programmed to generate the RMS error value (step 309) when the SBCF value is at the unacceptable level (see step 308). In step 310, the machine controller 90 determines whether the RMS error value is at an acceptable RMS level or an unacceptable RMS level. If the RMS error value is at an acceptable RMS level, the machine controller 90 locks the implement control gain value (see steps 311 and 312).

In an embodiment, if the RMS error value is at an unacceptable RMS level, the machine controller 90 sets the RMS error value as the aforementioned noise value in step 314 and proceeds in the manner described above with reference to FIG. 3. In operation, the machine controller 90 can be programmed to execute machine readable instructions to decrease the implement speed when the noise value is greater than the noise threshold and to increase the implement speed when the noise value is less than the noise threshold.

In an alternative embodiment, if the RMS error value is at an unacceptable RMS level, the machine controller 90 generates the aforementioned noise value in step 314 and proceeds in the manner described above with reference to FIG. 3.

The RMS error value may be compared to a RMS error value threshold to determine whether it is at an acceptable or unacceptable level. This threshold may be a discrete value or a range of values tailored to account for permissible variances in the threshold and/or permissible degrees to which the RMS error value may depart from the threshold without initiating corrective action. The RMS error value and the error value threshold may be measured in units of length and may be based on a square root of an average of a plurality of error ranges between squares of the adaptive and target signals. Where error ranges are employed, each of the error ranges may represent a difference between a pair of data points setting forth respective expected and actual position measurements of the earthmoving implement 30 related to the given operational terrain over a predetermined distance window. In particular embodiments, the distance window may be set to be greater than the length of the earthmoving machine, e.g., in a range of from about 30 m to about 50 m. While values described herein may utilize the entire distance window in their calculations, such values may alternatively utilize windows shorter than the distance window or combinations thereof, which windows or combinations thereof are also contemplated to be within the scope of this disclosure.

It is contemplated that the noise value analysis depicted in the operation flow charts of FIGS. 3-5, may be based on a comparison of the noise value to a noise threshold measured in units representing a distance within a time domain. This noise threshold may be a discrete value or a range of values tailored to account for permissible variances in the noise threshold and/or permissible degrees to which the noise value may depart from the threshold without initiating corrective action. In operation, the machine controller 90 can be programmed to execute machine readable instructions to increase the implement speed when the noise value is greater than the noise threshold and to decrease the implement speed when the noise value is less than the noise threshold. Typically, the noise threshold is measured in units of length and the time domain is measured in seconds.

According to one aspect of the present disclosure, it is contemplated that a Fast Fourier Transform (FFT) operation may be applied to the noise value to convert the noise value from a time domain into a frequency domain to generate a frequency-based noise value. This frequency-based noise value may be compared to a frequency-based noise threshold to determine whether the noise value is at the acceptable noise level or the unacceptable noise level. To this end, the earthmoving machine 100 may comprise a filtration device that applies a low pass filter, a high pass filter, a band pass filter, or a combination thereof, to the frequency-based noise value, the frequency-based noise threshold, or both, to replace the frequency-based noise value with a minimized associated noise. Further, in operation, the machine controller 90 can be programmed to execute machine readable instructions to decrease the implement speed when the noise value is greater than the noise threshold and to increase the implement speed when the noise value is less than the noise threshold.

It is also contemplated that the noise value may be generated, at least in part, by dividing a machine travel speed value by a terrain bump count frequency value. In this case, the machine controller 90 can be programmed to execute machine readable instructions to generate the machine travel speed value based on a distance the machine travels across a distance window in a time domain, i.e., by dividing distance traveled by a measured time. The terrain bump count frequency value can be generated based on a virtual noise generated from the adaptive signal measured over the given operational terrain over a time domain. The terrain bump count frequency value can be based on a measurement of cycles of virtual noise per unit time. The virtual noise is representative of counts of virtually detected bumps in the given operational terrain and the counts of virtually detected bumps are generated from the adaptive signal measured over the given operational terrain and divided by a measured time.

The machine controller 90 may comprises a single controller or a plurality of independent controllers. For example, and not by way of limitation, it is contemplated that the machine controller 90 may comprise a proportional-integral (PI) controller, a proportional-integral-derivative (PID) controller, an adaptive controller, or combinations thereof. In one embodiment, the machine controller 90 comprises a proportional-integral (PI) controller, the gain value reflects a tuning parameter of the PI controller, and the machine controller 90 is programmed to execute machine readable instructions to adjust a proportional term coefficient ($K_p$) associated with the PI controller to adjust the tuning parameter. In another embodiment, the machine controller 90 comprises a proportional-integral-derivative (PID) controller, the gain value reflects a tuning parameter of the PID controller, and the machine controller 90 is programmed to execute machine readable instructions to adjust a proportional term coefficient ($K_p$) associated with the PID controller, a derivative term coefficient ($K_d$) associated with the PID controller, or both, to adjust the tuning parameter. In yet another embodiment, the machine controller 90 comprises an $L_1$ adaptive controller, the gain value reflects a tuning parameter of the $L_1$ controller, and the machine controller 90 is programmed to execute machine readable instructions to adjust a coefficient ($a_m$) associated with the $L_1$ adaptive controller to adjust the tuning parameter.

The target position signal utilized by the machine controller 90 may be established based on a benching operation, where the earthmoving implement 30 is moved to a desired position with respect to the given operational terrain and the signal associated with the desired position is locked as the target signal. Alternatively, the target signal may be established based on a signal associated with a desired position in a predetermined virtual three-dimensional site plan, where the signal is generated by the adaptive environmental sensor, the machine controller 90, or both.

For the purposes of describing and defining the present invention, it is noted that reference herein to a characteristic of the subject matter of the present disclosure being a "function of" or "based on" a parameter, variable, or other characteristic is not intended to denote that the characteristic is exclusively a function of or based on the listed parameter, variable, or characteristic. Rather, reference herein to a characteristic that is a "function of" or "based on" a listed parameter, variable, etc., is intended to be open ended such that the characteristic may be a function of a single parameter, variable, etc., or a plurality of parameters, variables, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An earthmoving machine comprising a machine chassis, a linkage mechanism, an earthmoving implement, an adaptive environmental sensor, and control architecture, wherein:

the earthmoving implement is coupled to the machine chassis via the linkage mechanism;

the control architecture is configured to facilitate movement of the earthmoving implement, the machine chassis, and the linkage mechanism in one or more degrees of freedom at least partially in response to an implement control value and an adaptive signal;

the implement control value represents control of the movement of the earthmoving implement and comprises a gain value as a parameter thereof;

the implement control gain value is associated with a speed of movement of the earthmoving implement;

the adaptive signal is generated by the adaptive environmental sensor and is indicative of a measured position of the earthmoving implement relative to a given operational terrain; and the control architecture comprises a machine controller that is programmed to execute machine readable instructions to generate a noise value that is based on an error between the adaptive signal and a target position signal indicative of a target position of the earthmoving implement, determine whether the noise value is at an acceptable noise level or an unacceptable noise level, lock the implement control gain value when the noise value is at the acceptable noise level, adjust the implement control gain value to control the implement speed when the noise value is at the unacceptable noise level until the noise value is at the acceptable noise level, and the implement control gain value is locked, and operate the earthmoving machine based on the locked implement control gain value.

2. An earthmoving machine as claimed in claim 1 wherein the machine controller is further programmed to execute machine readable instructions to:

generate a RMS error value of the measured position of the earthmoving implement relative to the given operational terrain when the noise value is at the unacceptable noise level, the RMS error value being based on a comparison of the adaptive signal to the target position signal;

determine whether the RMS error value is at an acceptable RMS level or an unacceptable RMS level;

lock the implement control gain value when the RMS error value is at the acceptable RMS level; and set the RMS error value as the noise value when the RMS error value is at the unacceptable RMS level.

3. An earthmoving machine as claimed in claim 2 wherein the machine controller is programmed to execute machine readable instructions to decrease the implement speed when the noise value is greater than a noise threshold and increase the implement speed when the noise value is less than a noise threshold.

4. An earthmoving machine as claimed in claim 1 wherein the machine controller is further programmed to execute machine readable instructions to:

generate a RMS error value of the measured position of the earthmoving implement relative to the given operational terrain when the noise value is at the unacceptable noise level, the RMS error value being based on a comparison of the adaptive signal to the target position signal;

determine whether the RMS error value is at an acceptable RMS level or an unacceptable RMS level;

lock the implement control gain value when the RMS error value is at the acceptable RMS level; and generate the noise value when the RMS error value is at the unacceptable RMS level.

5. An earthmoving machine as claimed in claim 4 wherein:

the determination of whether the RMS error value is at the acceptable RMS level or the unacceptable RMS level is based on a comparison of the RMS error value to a RMS error value threshold;

the RMS error value is based on an average of a plurality of error ranges;

each of the plurality of error ranges depicts a difference between a pair of data points setting forth respective expected and actual position measurements of the earthmoving implement related to the given operational terrain and measured over a distance window; and the distance window is greater than a length of the earthmoving machine.

6. An earthmoving machine as claimed in claim 1 wherein:

the determination of whether the noise value is at the acceptable noise level or the unacceptable noise level is based on a comparison of the noise value to a noise threshold; and the noise threshold is measured in units representing a distance within a time domain.

7. An earthmoving machine as claimed in claim 6 wherein the machine controller is programmed to execute machine readable instructions to increase the implement speed when the noise value is greater than the noise threshold and decrease the implement speed when the noise value is less than the noise threshold.

8. An earthmoving machine as claimed in claim 1 wherein:

a Fast Fourier Transform (FFT) operation is applied to the noise value to convert the noise value from a time domain into a frequency domain to generate a frequency-based noise value; and the frequency-based noise value is compared to a frequency-based noise threshold to determine whether the noise value is at the acceptable noise level or the unacceptable noise level.

9. An earthmoving machine as claimed in claim 8 wherein the machine controller is programmed to execute machine readable instructions to decrease the implement speed when the noise value is greater than a noise threshold and increase the implement speed when the noise value is less than a noise threshold.

10. An earthmoving machine as claimed in claim 8 wherein the earthmoving machine comprises a filtration device that applies a low pass filter, a high pass filter, a band pass filter, or a combination thereof, to the frequency-based noise value, the frequency-based noise threshold, or both, to replace the frequency-based noise value with a minimized associated noise.

11. An earthmoving machine as claimed in claim 1 wherein:

the noise value is generated, at least in part, by dividing a machine travel speed value by a terrain bump count frequency value; and the machine controller is programmed to execute machine readable instructions to generate the machine travel speed value based on a distance the machine travels across a distance window in a time domain and the terrain bump count frequency value based on a virtual noise generated from the adaptive signal measured over the given operational terrain over a time domain.

12. An earthmoving machine as claimed in claim 11 wherein:

the terrain bump count frequency value is based on a measurement of cycles of virtual noise per unit time;

the virtual noise is representative of counts of virtually detected bumps in the given operational terrain; and the counts of virtually detected bumps are generated from the adaptive signal measured over the given operational terrain and divided by a measured time.

13. An earthmoving machine as claimed in claim 1 wherein the machine controller comprises a single controller or a plurality of independent controllers.

14. An earthmoving machine as claimed in claim 1 wherein:

the machine controller comprises a proportional-integral (PI) controller;

the gain value reflects a tuning parameter of the PI controller; and the machine controller is programmed to execute machine readable instructions to adjust a proportional term coefficient ($K_p$) associated with the PI controller to adjust the tuning parameter.

15. An earthmoving machine as claimed in claim 1 wherein:

the machine controller comprises a proportional-integral-derivative (PID) controller;

the gain value reflects a tuning parameter of the PID controller; and the machine controller is programmed to execute machine readable instructions to adjust a proportional term coefficient ($K_p$) associated with the PID controller, a derivative term coefficient ($K_d$) associated with the PID controller, or both, to adjust the tuning parameter.

16. An earthmoving machine as claimed in claim 1 wherein:

the machine controller comprises an $L_1$ adaptive controller;

the gain value reflects a tuning parameter of the $L_1$ adaptive controller; and the machine controller is programmed to execute machine readable instructions to adjust a coefficient ($a_m$) associated with the $L_1$ adaptive controller to adjust the tuning parameter.

17. An earthmoving machine as claimed in claim 1 wherein:

the machine controller is programmed to execute machine readable instructions to establish the target position signal based on a benching operation; and the benching operation comprises moving the earthmoving implement to a desired position with respect to the given operational terrain and locking a signal associated with the desired position as the target position signal.

18. An earthmoving machine as claimed in claim 1 wherein:

the machine controller is programmed to execute machine readable instructions to establish the target position signal based on a signal associated with a desired position with respect to the given operational terrain in a predetermined virtual three-dimensional site plan; and the signal is generated by the adaptive environmental sensor, the machine controller, or both.

19. An earthmoving machine comprising a machine chassis, a linkage mechanism, an earthmoving implement, an adaptive environmental sensor, and control architecture, wherein:

the earthmoving implement is coupled to the machine chassis via the linkage mechanism;

the control architecture is configured to facilitate movement of the earthmoving implement, the machine chassis, and the linkage mechanism in one or more degrees of freedom at least partially in response to an implement control value and an adaptive signal;

the implement control value represents control of the movement of the earthmoving implement and comprises a gain value as a parameter thereof;

the implement control gain value is associated with a speed of movement of the earthmoving implement;

the adaptive signal is generated by the adaptive environmental sensor and is indicative of a measured position of the earthmoving implement relative to a given operational terrain; and the control architecture comprises a machine controller that is programmed to execute machine readable instructions to generate a noise value, wherein the noise value that is based on an error between the adaptive signal and a target position signal indicative of a target position of the earthmoving implement and is generated, at least in part, by dividing a machine travel speed value by a terrain bump count frequency value, determine whether the noise value is at an acceptable noise level or an unacceptable noise level by applying a Fast Fourier Transform (FFT) operation to the noise value to convert the noise value from a time domain into a frequency domain to generate a frequency-based noise value and comparing the frequency-based noise value to a frequency-based noise threshold, lock the implement control gain value when the noise value is at the acceptable noise level, adjust the implement control gain value to decrease the implement speed when the noise value is greater than a noise threshold and increase the implement speed when the noise value is less than a noise threshold until the noise value is at the acceptable noise level, and the implement control gain value is locked, and operate the earthmoving machine based on the locked implement control gain value.

20. A method of operating an earthmoving machine, the method comprising:

disposing an earthmoving machine on a given operational terrain, the earthmoving machine comprising a machine chassis, a linkage mechanism, an earthmoving implement, an adaptive environmental sensor, and control architecture comprising a machine controller, wherein the earthmoving implement is coupled to the machine chassis via the linkage mechanism;

utilizing the control architecture to facilitate movement of the earthmoving implement, the machine chassis, and the linkage mechanism in one or more degrees of freedom at least partially in response to an implement control value and an adaptive signal, wherein the implement control value represents control of the movement of the earthmoving implement and comprises a gain value as a parameter thereof, the implement control gain value is associated with a speed of movement of the earthmoving implement, and the adaptive signal is generated by the adaptive environmental sensor and is indicative of a measured position of the earthmoving implement relative to the given operational terrain;

generating, by the machine controller, a noise value that is based on an error between the adaptive signal and a target position signal indicative of a target position of the earthmoving implement;

determining whether the noise value is at an acceptable noise level or an unacceptable noise level;

locking the implement control gain value when the noise value is at the acceptable noise level;

adjusting, by the machine controller, the implement control gain value to control the implement speed of the earthmoving implement when the noise value is at the unacceptable noise level until the noise value is at the acceptable noise level, and the implement control gain value is locked; and operating the earthmoving machine based on the locked implement control gain value.

* * * * *